United States Patent [19]

Stock et al.

[11] Patent Number: 4,986,732

[45] Date of Patent: Jan. 22, 1991

[54] STEAM TURBINE CROSSOVER PIPING WITH REDUCED TURNING LOSSES

[75] Inventors: Alvin L. Stock, Casselberry; John C. Groenendaal, Jr., Winter Springs, both of Fla.

[73] Assignee: Westinghouse Electric Corp., Pittsburgh, Pa.

[21] Appl. No.: 389,139

[22] Filed: Aug. 3, 1989

[51] Int. Cl.[5] ..... F01D 1/24; F01D 13/00; F03D 13/02; F04D 13/04

[52] U.S. Cl. ..... 415/066; 415/67; 415/101; 415/126; 415/182.1; 285/157; 285/179; 138/155

[58] Field of Search ..... 415/60, 61, 66, 67, 415/68, 100, 101, 126, 182.1; 285/157, 179; 138/39, 155, 177, DIG. 6, 4, 8

[56] References Cited

U.S. PATENT DOCUMENTS

| | | | |
|---|---|---|---|
| 1,651,186 | 3/1924 | Clark et al. | 285/179 |
| 1,671,789 | 5/1928 | Smith | 285/179 |
| 2,590,392 | 4/1950 | Feilden | 285/179 |

*Primary Examiner*—Edward K. Look
*Assistant Examiner*—Thomas Denion

[57] ABSTRACT

In a steam turbine having a first turbine element adapted to receive a flow of steam for operating at a first predetermined pressure, the first turbine element including an exhaust protion, a second turbine element adapted to receive the flow of steam for operating at a second predetermined pressure that is relatively lower than the first predetermined pressure, the second turbine element including an inlet portion, a method and apparatus for connecting the inlet portion to the exhaust portion by crossover piping which includes a pair of vaneless turning subsections each of which have a substantially long radius of curvature.

18 Claims, 4 Drawing Sheets

STEAM TURBINE CROSSOVER PIPING WITH REDUCED TURNING LOSSES

BACKGROUND OF THE INVENTION

1. Field of the Invention

The present invention is related generally to steam turbines, and more particularly to crossover piping used in such steam turbines.

2. Statement of the Prior Art

"Crossover" piping is typically employed in a steam turbine-generator frame to facilitate the passage of a flow of steam from a relatively high pressure portion of the steam turbine (e.g., a high pressure turbine element or an intermediate turbine pressure element of the steam turbine) to a relatively lower pressure portion thereof (e.g., a low pressure turbine element of the steam turbine). As is readily apparent, such piping between the turbine elements of a steam turbine should not constitute a "stiff piping system", since it must of necessity allow for the expansion and contraction and other similar such movements that go along with an operating steam turbine. A sufficient amount of flexibility can typically be provided in such crossover piping, however, by using one or more hinged bellows expansion joints. That is, where space limitations and other design considerations result in configurations of insufficient flexibility, capacity for deflection within allowable stress range limits may be increased to provide a semirigid, or even a non-rigid system, and the expansion effects essentially eliminated by a free-movement system.

As is well known, expansion joints for semirigid or non-rigid systems can be restrained against longitudinal and lateral movement by the hinges with the expansion element under bending movement only, and are referred to as "rotation" or "hinged" joints. Semirigid systems are limited to one plane, while non-rigid systems require a minimum of three joints (e.g., in the configuration that is typically used in crossover piping installations) for two-dimensional expansion movement. In those situations were it becomes necessary to provide three-dimensional expansion movement, five joints must be installed.

Commercial bellows elements are usually formed of a light gage (on the order of 0.05 to 0.10 inches thick) material, and are available in stainless and other alloy steels, copper and other non-ferrous materials. Multiply bellows, bellows with external reinforcing rings, and toroidal contour bellows are also available for high pressure installations. Typical of the bellows elements that are suitable for crossover piping installations are those manufactured by Westinghouse Electric Corporation for use with their turbine building blocks 245 and 271M or 271H.

There are three basic designs of crossover piping installations that are presently used for conventional steam turbines. Two of these three basic designs (i.e., the commercial balanced expansion joint design and the link-hinge diaphragm or "LHD" design) utilize turning vanes to facilitate a flow of steam. Both designs are similar in that they employ: (1) a straight, vertical section of piping, including an expansion joint, from the exhaust of the high pressure or intermediate pressure turbine element of the steam turbine; (2) a straight, vertical section of piping into the inlet of the low pressure turbine element of the steam turbine; and, (3) a straight, horizontal section of piping, including a pair of expansion joints, which joins the straight, vertical sections. The turning vanes are used within the elbow junctions of the piping sections, and the two designs vary only in their use of a different type of expansion joint. However, the LHD design is the more popular design (especially at installations having a single LP turbine element) because it is considerably less expensive than the commercial balanced expansion joint design.

The remaining basic design of crossover piping installation that is presently used for conventional steam turbines is the "short radius" crossover pipe, which also uses the link-hinge diaphragm as expansion joints but does not use turning vanes. Such elimination of the turning vanes has the advantages of reducing the costs and complexity of the crossover piping design, but it also has the disadvantage of a poor flow of steam and attendant losses of efficient heat. That is, because of the "short radius" nature of the elbows that are used in this crossover piping design, the steam will not flow as readily as it would in through an elbow having a longer radius of turn. By definition, therefore, "long radius" crossover piping would employ turning subsections which redirect the flow of steam by substantially 90° (e.g., from a vertical direction to a horizontal direction or vice versa) over a greater distance than "short radius" crossover piping.

Since bellows elements that are used in crossover piping are ordinarily rated for strain ranges which involve repetitive yielding, predictable performance is assured only by adequate fabrication controls and knowledge of the potential fatigue performance of each design. The attendant cold work on bellows elements can affect their corrosion resistance and promote a greater susceptibility to corrosion fatigue or stress corrosion. For example, expansion joints in a horizontal position (e.g., those which are used in the straight, vertical section of piping normally exiting the exhaust of the HP/IP turbine element of a steam turbine) cannot be drained and have frequently undergone pitting or cracking due to the presence of condensate whether during operations of the steam turbine or offstream.

SUMMARY OF THE INVENTION

Accordingly, it is a general object of the present invention to provide steam turbine crossover piping with reduced turning losses. More specifically, an object of the present invention is to provide an improved method of coupling an inlet portion of a low pressure turbine element of a steam turbine to an exhaust portion of a high and/or intermediate turbine element of that steam turbine.

Another object of the present invention is to provide steam turbine crossover piping with reduced turning losses, but without the use of turning vanes.

Still another object of the present invention is to provide vaneless steam turbine crossover piping, as well as an improved method of coupling the inlet portion of the low pressure turbine element of the steam turbine to the exhaust portion of the high and/or intermediate turbine element of that steam turbine, while nevertheless maintaining a cost-effective, simple and corrosion-resistant design.

Briefly, these and other objects according to the present invention are accomplished by a steam turbine, comprising a first turbine element adapted to receive a flow of steam for operating at a first predetermined pressure, the first turbine element including an exhaust portion, a second turbine element adapted to receive the flow of steam for operating at a second predetermined pressure that is relatively lower than the first predetermined pressure, the second turbine element including an inlet portion, and a piping section connecting the inlet portion to the exhaust portion, the piping section including a pair of turning subsections each of which have a substantially long radius of curvature.

In accordance with one important aspect of the present invention, neither of the turning subsections includes a turning vane, thereby substantially reducing the costs associated with the design and installation of typical crossover piping systems. Furthermore, and in accordance with presently preferred embodiments of this invention, each of the turning subsections includes a portion of piping with expansion joint means installed therein, such expansion joint means in each piping portion of the turning subsections being disposed at an angle of less than a substantially vertical position but greater than a substantially horizontal position.

The crossover piping, in accordance with another important aspect of the present invention, further comprises a substantially horizontal portion of piping connecting the pair of turning subsections. Such substantially horizontal piping portion may also include expansion joint means installed therein. Alternatively, the turning subsection proximate to the first turbine element may include a substantially vertical portion of piping with expansion joint means disposed perpendicularly thereacross. In either case, and in accordance with presently preferred embodiments of this invention, all of the expansion joint means comprise a link-hinge diaphragm.

Other objects, advantages and novel features according to the present invention will become more apparent from the following detailed description of preferred embodiments thereof, when considered in conjunction with the accompanying drawings wherein:

DETAILED DESCRIPTION OF THE PREFERRED EMBODIMENTS

Figure 1:
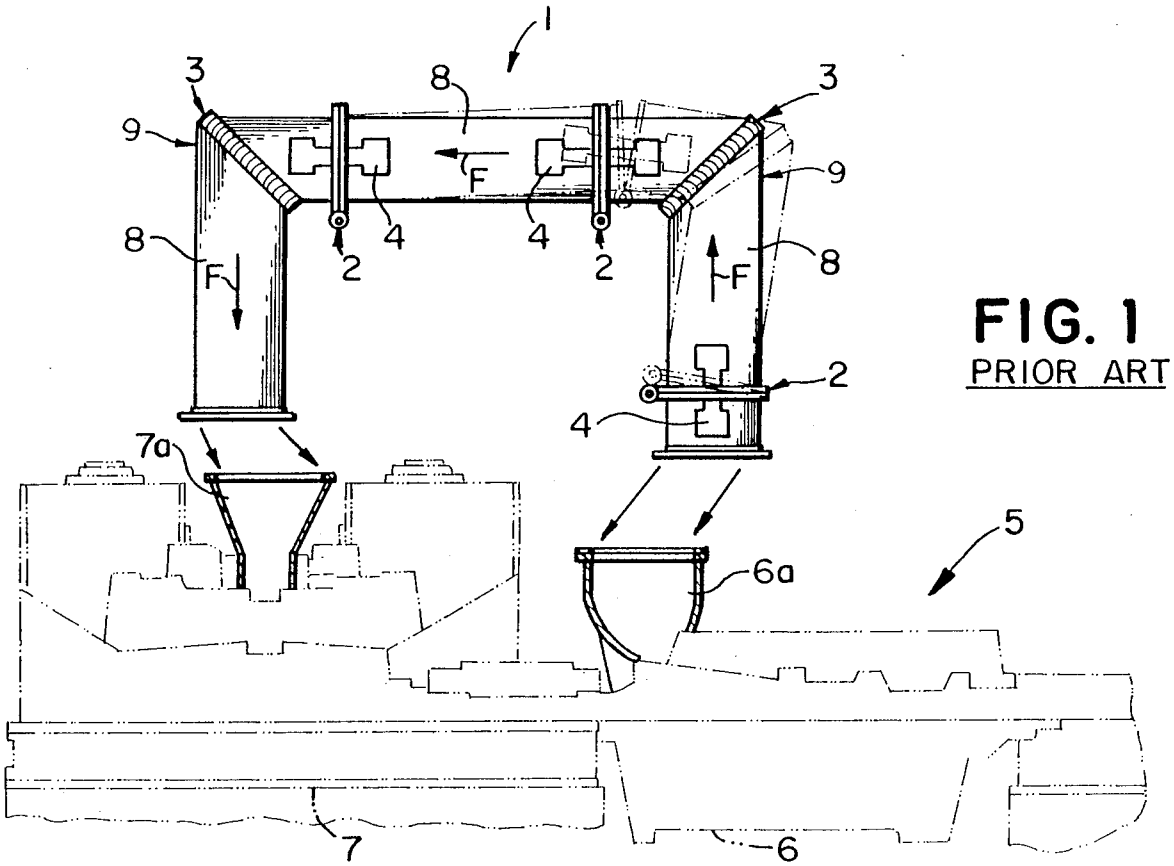
FIG. 1 PRIOR ART
FIG. 1 illustrates one prior art crossover piping system utilizing link-hinge diaphragms and a plurality of turning vanes.
Figure 2:
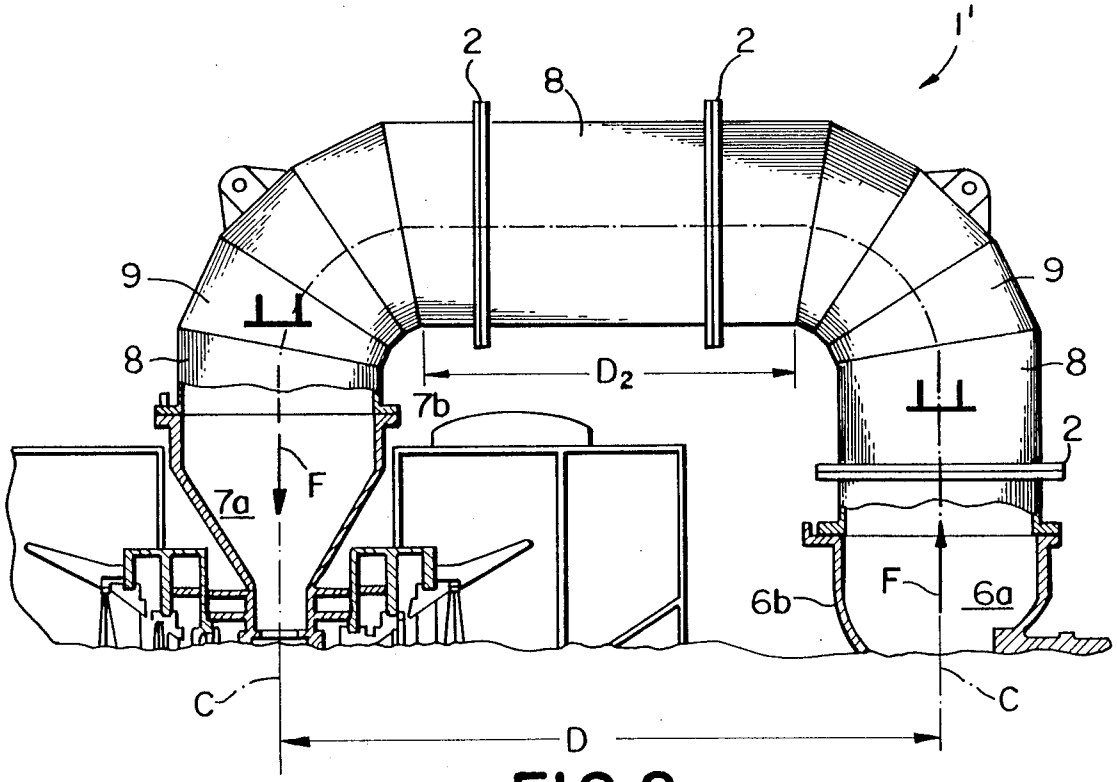
FIG. 2 PRIOR ART
FIG. 2 illustrates another prior art crossover piping system utilizing link-hinge-diaphragms and a pair of "short radius" elbows.

Referring now to the drawings, wherein like numbers designate like or corresponding parts throughout each of the several views, there are shown in FIGS. 1 and 2 two crossover piping systems of the prior art.

FIG. 1 illustrates one prior art crossover piping system 1 that utilizes link-hinge diaphragms 2 and a plurality of turning vanes 3. Each of the link-hinge diaphragms 2 used in such known crossover piping systems 1 also include "dog-bone" structures 4. Moreover, as is well known, such known crossover piping systems 1 serve to facilitate a passage of steam through a steam turbine 5 having a first turbine element 6 that is adapted to receive a flow of steam F for operating at a first predetermined pressure (e.g., the operating pressures of conventional high pressure and/or intermediate pressure turbine elements of the steam turbine 5), and a second turbine element 7 that is adapted to receive the flow of steam F for operating at a second predetermined pressure that is relatively lower than the first predetermined pressure (e.g., the operating pressure of a conventional low pressure turbine element of the steam turbine 5).

Typically in such crossover piping systems 1, the first and second turbine elements 6, 7 are coupled together by three straight sections of piping 8. One such piping section 8 is disposed vertically and is connected to an exhaust portion 6*a* (the face of which is horizontally-disposed as shown in FIG. 1) of the first turbine element 6, while another vertically-disposed piping section 8 is connected to an inlet portion 7*a* (the face of which also is horizontally-disposed as shown in FIG. 1) of the second turbine element 7. The remaining piping section 8 is horizontally-disposed and connects the pair of vertically-disposed piping sections 8 by way of elbow sections 9 of substantially 90° included angle which contain the turning vanes 3.

As is well known, the link-hinge diaphragms 2 and "dog-bone" structures 4 permit the piping sections 8 to expand and contract with use (as is shown in phantom in FIG. 1) without cracking, the link-hinge diaphragms 2 serving to contain the flow of steam F and the "dog-bone" structures 4 serving to absorb any axial loads. Because of the severely "short radius" of the 90° elbow sections 9, however, the crossover piping system 1 requires the installation of the turning vanes 3 to promote good flow characteristics. The additional requirement of such turning vanes 3 not only adds to the complexity of the design of the crossover piping system 1, but it also adds to the overall costs of such system.

Referring now to FIG. 2, an alternative prior art crossover piping system 1, is shown. Like the crossover piping system 1 shown in FIG. 1, the crossover piping system 1, utilizes link-hinge diaphragms 2. However, such crossover piping system 1, eliminates the use of turning vanes 3 (and thereby significantly reduces the costs and complexity of its design) by using a pair of "short radius" elbow sections 9. Each of the piping sections 8 in the crossover piping system 1′ are also much shorter than their counterparts in the crossover piping system 1 shown in FIG. 1 (given the same distance D between centerlines C of exhaust and inlet portions 6*a*, 7*a*) in order to accommodate the "short radius" elbow sections 9.

It should be noted at this juncture that, while the radius of curvature of each "short radius" elbow section 9 shown in FIG. 2 is relatively longer by comparison to the radius of curvature of each 90° elbow section 9 shown in FIG. 1, it is nevertheless deemed to comprise a "short radius" because of the relatively minor portion of the distance D which it takes up. This "short radius" feature is further borne out by the relatively major portion D2 of the distance D which is taken up by the piping section 8 that is horizontally-disposed.

Through the elimination of turning vanes 3 from the crossover piping system 1′, an approximate cost savings of one-third in design can be accomplished. However, by utilizing "short radius" elbow sections 9 without the turning vanes 3, an attendant loss of on the order of a few BTUs in thermal efficiency (as quantified in terms of "heat rate" is experienced.

Figure 3:
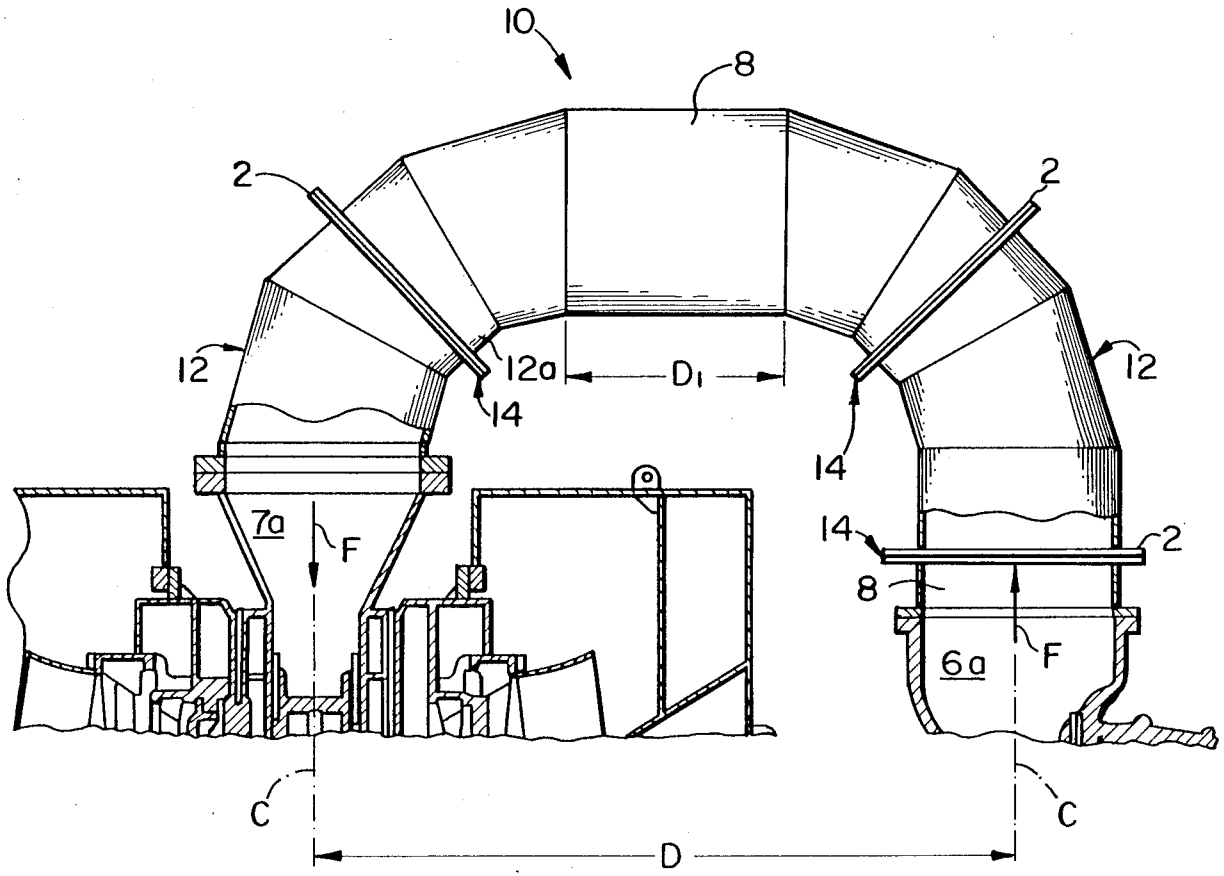
FIG. 3 illustrates a long radius vaneless crossover piping system in accordance with one presently preferred embodiment of this invention.

Therefore, and referring now to FIG. 3, a "long radius" crossover piping system 10 in accordance with one presently preferred embodiment of this invention is shown. Such crossover piping system 10, like the "short radius" crossover piping system 1, shown in FIG. 2, does not utilize turning vanes 3. Nevertheless, by extending the radius of curvature of such crossover piping system 1' and by modifying its placement of the link-hinge diaphragms 2, significant advantages in the costs, complexity and flow characteristics may be achieved by the crossover piping system 10 shown in FIG. 3.

The crossover piping system 10 generally comprises a pair of turning subsections 12, a first of which is connected to the exhaust portion 6a and a second of which is connected to the inlet portion 7a, and a substantially horizontal portion of piping 8 connecting the pair of turning subsections 12. Each of the turning subsections 12 has a substantially "long radius" of turn and includes a portion of piping 12a with expansion joint means 14 installed therein.

In accordance with one important aspect of the present invention, the expansion joint means 14 of each piping portion 12a comprises a link-hinge diaphragm 2 and "dog-bone" structure 4 (not shown in FIG. 3 for piping portion 12a being disposed at an angle of less than a substantially vertical position but greater than a substantially horizontal position. As a result of this placement of the pair of link-hinge diaphragms 2 farther apart than they normally would be in the prior art crossover piping systems 1, 1' of FIGS. 1 and 2, several advantages are realized.

First of all, only short segments of straight, cylindrical piping are required, thereby facilitating overall construction of the "long radius" crossover piping system 10. Such turning subsections 12 which have a relatively long radius of curvature also promote good steam flow characteristics. Moreover, because the expansion joint means 14 in the turning subsections 12 can be placed farther apart, their link-hinge diaphragms 2 need not be as flexible as compared to those used in the "short radius" crossover piping system 1' shown in FIG. 2. This reduction in a requirement of flexibility also permits fewer link-hinge diaphragms 2 to be used, thus further reducing the costs and complexity of the crossover piping system 10.

It should be noted at this juncture that the piping portions 12a are, of economic necessity, straight. This facilitates installation of the "dog-bone" structures 4 (not shown in FIG. 3 for simplicity), because as is well known, the curvature of the face of those "dog-bone" structures 4 must substantially match the curvature of the pipe within which they are installed. As such, a straight piping portion 12a prevents the manufacture of the "dog-bone" structures 4 from becoming expensive and unduly complex.

In the crossover piping system 10 shown in FIG. 3, the faces of exhaust portion 6a and the inlet portion 7a are disposed in a substantially horizontal position, and the flow of steam F exiting the exhaust portion 6a and entering the inlet portion 7a does so in a substantially vertical direction. Furthermore, it can be seen from FIG. 3 that the exhaust portion 6a is relatively lower than the inlet portion 7a. Where necessitated by such constraints, therefore, the crossover piping system 10 according to FIG. 3 may also comprise a substantially vertical portion of piping 8 with expansion joint means 14 disposed perpendicularly thereacross.

Figure 4:
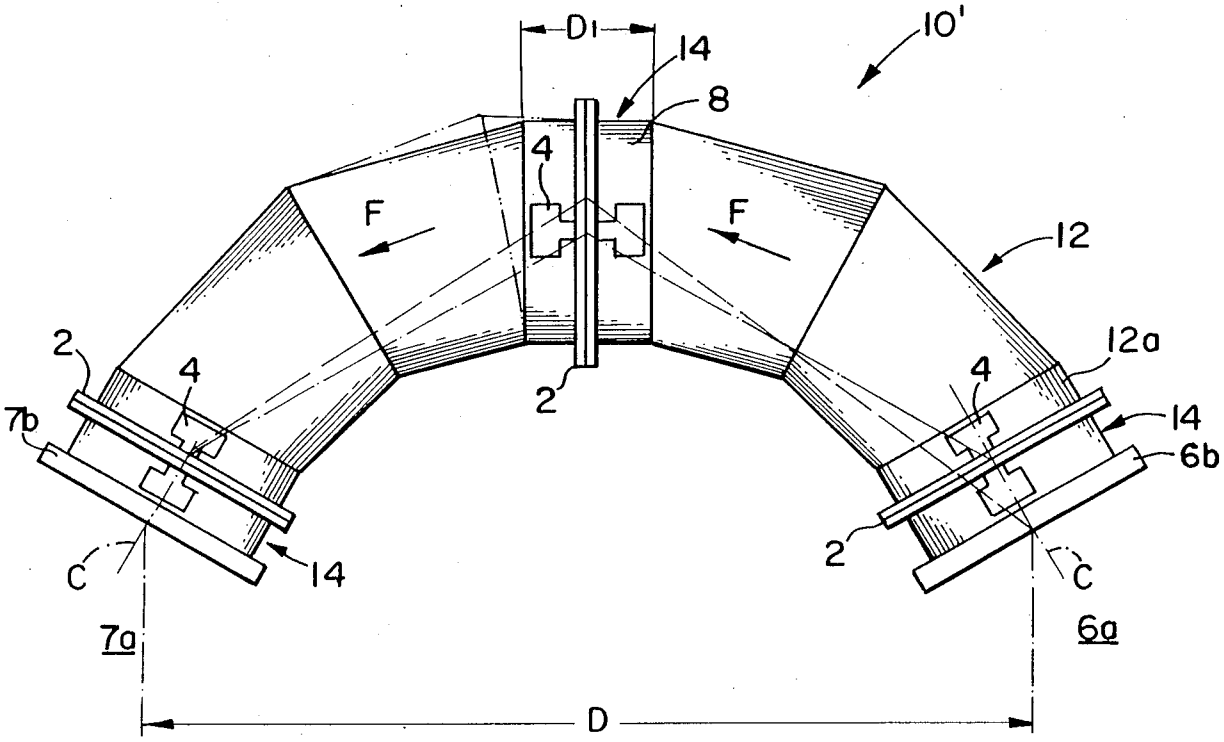
FIG. 4 illustrates a long radius vaneless crossover piping system in accordance with another presently preferred embodiment of the invention.

Referring now to FIG. 4, a long radius vaneless crossover piping system 10' in accordance with another presently preferred embodiment of the invention is shown. Like the crossover piping system 10 shown in FIG. 3, the crossover piping system 10' generally comprises a pair of turning subsections 12, a first of which is connected to the exhaust portion 6a and a second of which is connected to the inlet portion 7a, and a substantially horizontal portion of piping 8 connecting the pair of turning subsections 12. Each of the turning subsections 12 also have a substantially "long radius" of turn and includes a portion of piping 12a with expansion joint means 14 installed therein.

The expansion joint means 14 of each piping portion 12a in the crossover piping system 10, also comprises a link-hinge diaphragm 2 and "dog-bone" structure 4, with the link-hinge diaphragm 2 in each such expansion joint means 14 also being disposed at an angle of less than a substantially vertical position but greater than a substantially horizontal position. The same advantages noted above with respect to such placement of the link-hinge diaphragms 2 farther apart than they normally would be in the prior art crossover piping systems 1, 1' of FIGS. 1 and 2, are realized.

In contradistinction to the crossover piping systems 1, 1, and 10 of FIGS. 1–3, the faces of the exhaust portion 6a and the inlet portion 7a of the crossover piping system 10' (i.e., where the piping portions 12a connect to the exhaust portion 7a and the inlet portion 8a) are each disposed at an angle of less than a substantially vertical position but greater than a substantially horizontal position. That is, a casing structure 6b of the first turbine element 6 is modified to incline the face of the exhaust portion 6a, while a casing structure 7b of the second turbine 7 is modified to incline the face of the inlet portion 7a.

The amount of modification to the casing structures 6b and 7b which may be necessary to achieve a particular angle of inclination for the exhaust portion 6a and the inlet portion 7a is clearly a matter of design choice dependent not only upon the horizontal and vertical spacing between such exhaust portion 6a and inlet portion 7a, but also upon the type of the second turbine element (i.e., whether the low pressure turbine element is of the double flow type or the single flow type).

It should be noted at this juncture that the piping portion 8 connecting the pair of turning subsections 12 in both crossover piping systems 10 and 10' comprises a minor portion D1 of the distance D between respective centerlines of the exhaust portion 6a and inlet portion 7a. As a result, a "long radius" configuration of its associated crossover piping system 10, 10' is ensured. Because the casing structures 6b, 7b of the crossover piping system 10' are modified to provide the angled exhaust portion 6a and inlet portion 7a, however, the piping portion 8 connecting the pair of turning subsections 12 in the crossover piping system 10' comprises an even smaller minor portion D1 than the minor portion D1 comprised of the piping portion 8 connecting the pair of turning subsections 12 in the crossover piping system 10. The crossover piping system 10', therefore, has a longer radius of curvature than the crossover piping system 10.

It should also be noted at this juncture that the crossover piping system 10, substantially eliminates the problems of corrosion fatigue, stress corrosion, pitting and cracking noted above because none of the expansion joint means 14 is horizontally disposed. Moreover, the configuration of the crossover piping system 10' when compared to the crossover piping system 10 permits a shorter overall structure, thereby facilitating access by overhead cranes in buildings of reduced heights.

The improved method of coupling the inlet portion *7a* to the exhaust portion *6a* in accordance with the present invention generally comprises the steps of:

(1) providing a first vaneless turning subsection of piping having a substantially long radius of turn such as the turning subsections 12 shown in FIGS. 3 and 4;

(2) connecting that first subsection 12 to the exhaust portion *6a;*

(3) providing a second vaneless turning subsection of piping having a substantially long radius of turn such as the turning subsections 12 shown in FIGS. 3 and 4;

(4) connecting the second subsection 12 to the inlet portion *7a;*

(5) providing each turning subsection 12 with a portion of piping 12*a* having expansion joint means 14 installed therein;

(b 6) disposing the expansion joint means 14 in each piping portion 12*a* of the subsections 12 at an angle of less than a substantially vertical position but greater than a substantially horizontal position;

(7) providing a substantially horizontal portion of piping such as the piping portion 8 shown in FIGS. 3 and 4;

(8) connecting the first and second subsections 12 with the substantially horizontal portion of piping 8;

(9) providing expansion joint means 14 for the piping portion 8; and

(10) installing the expansion joint means 14 in the substantially horizontal portion of piping 8. Each of the expansion joint means 14 used according to this improved method preferably comprise a link-hinge diaphragm 2 and "dog-bone" structure 4. Where problems associated with reduced building height, overhead crane access, corrosion fatigue, stress corrosion, pitting and cracking are to be faced, the improved method further comprises the steps of:

(11) disposing the exhaust portion *6a* at an angle of less than a substantially vertical position but greater than a substantially horizontal position; and

(12) disposing the inlet portion *7a* at an angle of less than a substantially vertical position but greater than a substantially horiZontal position.

There has, thus, been provided by the foregoing disclosure steam turbine crossover piping systems with reduced turning losses. More specifically, an improved method of coupling an inlet portion of a low pressure turbine element of a steam turbine to an exhaust portion of a high and/or intermediate turbine element of that steam turbine has been disclosed in which the steam turbine crossover piping is provided with reduced turning losses, but without the use of turning vanes. The long radius crossover piping system according to the present invention not only improves steam flow characteristics, but also maintains a cost-effective, simple and corrosion-resistant design.

Obviously, many modifications and variations of the present invention are possible in light of the foregoing disclosure. It is to be understood, therefore, that within the scope of the appended claims, the present invention may be practiced otherwise than as is specifically described herein.

We claim as our invention:

1. A steam turbine, comprising:

a first section adapted to receive a flow of steam for operating at a first predetermined pressure, said first section including an exhaust portion disposed at an angle of less than a substantially vertically position but greater than a substantially horizontal position;

a second section adapted to receive said flow of steam for operating at a second predetermined pressure that is relative lower than said first predetermined pressure, said second section including an inlet portion disposed at an angle of less than a substantially vertical position but greater than a substantially horizontal position; and a piping section connecting said inlet portion to said exhaust portion, said piping section including a pair of turning subsections each of which have a radius of curvature, wherein said exhaust portion and said inlet portion each include centerline, and said centerlines of said exhaust portion and said inlet portion are separated by a predetermined distance and said radius of curvature of said turning subsections comprises a major portion of said predetermined distance.

2. The steam turbine according to claim 1, wherein neither said turning subsection includes a turning vane.

3. The steam turbine according to claim 1, wherein said turning subsection proximate to said first turbine element includes a substantially vertical portion of piping with expansion joint means disposed perpendicularly thereacross.

4. The steam turbine according to claim 3, wherein said expansion joint means comprises a link-hinge diaphragm.

5. The steam turbine according to claim 1, further comprising a substantially horizontal portion of piping connecting said pair of turning subsections.

6. The steam turbine according to claim 5, further comprising expansion joint means installed in said substantially horizontal piping portion.

7. The steam turbine according to claim 6, wherein said expansion joint means each comprise a link-hinge diaphragm.

8. The steam turbine according to claim 5, wherein said substantially horizontal piping portion comprises a minor portion of said predetermined distance.

9. The steam turbine according to claim 1, wherein said exhaust portion and said inlet portion are each disposed in a substantially horizontal position, said flow of steam exiting said exhaust portion and entering said inlet portion in a substantially vertical direction.

10. A crossover piping system for a steam turbine having a first section that is adapted to receive a flow of steam at a first predetermined pressure, the first section including an exhaust portion, and a second section that is adapted to receive the flow of steam from the first section at a second predetermined pressure relatively lower than the first predetermined pressure, the second section including an inlet portion, said crossover piping system comprising:

a first vaneless turning subsection of piping connected to the exhaust portion;

a second vaneless turning subsection of piping connected to the inlet portion;

wherein each of said turning subsections has a radius of curvature and includes a portion of piping with expansion joint means installed therein, said expansion joint means in each said piping portion of said turning subsections disposed at an angle of less than a substantially vertical position but greater than a substantially horizontal position; and a substantially horizontal portion of piping connecting said pair of turning subsections, and having expansion joint means installed therein, wherein said exhaust portion and said inlet portion each include a centerline, and said centerlines of said exhaust portion and said inlet portion are separated by a predetermined distance and said radius of curvature of said turning subsections comprises a major portion of said predetermined distance.

11. The crossover piping system according to claim 10, wherein said expansion joint means each comprise a link-hinge diaphragm.

12. The crossover piping system according to claim 10, wherein said exhaust portion and said inlet portion are each disposed in a substantially horizontal position, said flow of steam exiting said exhaust portion and entering said inlet portion in a substantially vertical direction.

13. The crossover piping system according to claim 10, wherein said exhaust portion and said inlet portion are each disposed at an angle of less than a substantially vertical position but greater than a substantially horizontal position.

14. The crossover piping system according to claim 10, wherein said substantially horizontal piping portion comprises a minor portion of said predetermined distance.

15. In a steam turbine having a first section operating at a first predetermined pressure, the first section including an exhaust portion, and a second section operating at a second predetermined pressure relatively lower than the first predetermined pressure, the second section including an inlet portion coupled to receive a flow of steam from the exhaust portion, an improved method of coupling the inlet portion to the exhaust portion comprising the steps of:

providing a first vaneless turning subsection of piping having a radius of curvature;

connecting said first subsection to the exhaust portion;

providing a second vaneless turning subsection of piping having a radius of;

connecting said second subsection to the inlet portion;

providing each said turning subsection with a portion of piping having expansion joint means installed therein;

disposing said expansion joint means in each said piping portion of said subsections at an angle of less than a substantially vertical position but greater than a substantially horizontal position;

providing a substantially horizontal portion of piping;

connecting said first and second subsections with said substantially horizontal portion of piping; and installing expansion joint means in said substantially horizontal portion of piping;

wherein the exhaust portion and the inlet portion each include a centerline, and said centerlines of the exhaust portion and the inlet portion are separated by a predetermined distance, and wherein said step of providing said substantially horizontal piping portion further comprises the step of ensuring that said substantially horizontal piping portion comprises a minor portion of said predetermined distance.

16. The method according to claim 15, wherein said steps of providing said expansion joint means each comprise the step of providing a link-hinge diaphragm.

17. The method according to claim 16, further comprising the steps of:

disposing the exhaust portion in a substantially horizontal position; and disposing the inlet portion in a substantially horizontal position;

wherein the flow of steam exiting said exhaust portion and entering said inlet portion flows in a substantially vertical direction.

18. The method according to claim 15, further comprising the steps of:

disposing the exhaust portion at an angle of less than a substantially vertical position but greater than a substantially horizontal position; and disposing the inlet portion at an angle of less than a substantially horizontal position.

* * * * *